US010294882B2

(12) United States Patent
Sanborn et al.

(10) Patent No.: US 10,294,882 B2
(45) Date of Patent: May 21, 2019

(54) METHODS AND SYSTEMS FOR ADJUSTING FUELING OF ENGINE CYLINDERS

(71) Applicant: Ford Global Technologies, LLC, Dearborn, MI (US)

(72) Inventors: Ethan D. Sanborn, Saline, MI (US); Mark Thomas Linenberg, Pickney, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/615,575

(22) Filed: Jun. 6, 2017

(65) Prior Publication Data

US 2018/0347494 A1 Dec. 6, 2018

(51) Int. Cl.

| | |
|---|---|
| ***F02D 41/14*** | (2006.01) |
| ***F02D 41/22*** | (2006.01) |
| ***F02D 41/30*** | (2006.01) |
| *F02D 19/06* | (2006.01) |

(52) U.S. Cl.

CPC ..... *F02D 41/1454* (2013.01); *F02D 41/222* (2013.01); *F02D 41/3094* (2013.01); *F02D 19/0665* (2013.01); *F02D 41/221* (2013.01)

(58) Field of Classification Search

CPC ..... F02D 41/04; F02D 41/14; F02D 41/1454; F02D 41/1456; F02D 41/22; F02D 41/222; F02D 41/24; F02D 41/2406; F02D 41/26; F02D 41/30; F02D 41/3094

USPC ..... 123/295–299, 301–305; 701/102–105, 701/111, 114, 115

See application file for complete search history.

(56) References Cited

U.S. PATENT DOCUMENTS

| | | | | |
|---|---|---|---|---|
| 7,150,266 | B2 | 12/2006 | Nakayama et al. | |
| 9,631,573 | B2 | 4/2017 | Surnilla et al. | |
| 2016/0131072 | A1* | 5/2016 | Surnilla | F02D 41/1454 701/107 |
| 2018/0051647 | A1* | 2/2018 | Ranga | F02D 41/2467 |

* cited by examiner

*Primary Examiner* — John Kwon
*Assistant Examiner* — Johnny H Hoang
(74) *Attorney, Agent, or Firm* — Julia Voutyras; McCoy Russell LLP

(57) ABSTRACT

Methods and systems are provided for enabling a transfer function of a direct injector and a port injector, each fueling an engine cylinder, to be accurately learned. During selected conditions, the direct injected fuel fraction may be actively changed from a target fraction to one of an upper and lower limit of the direct injector so as to provide a measurable air-fuel ratio error. Fueling errors for the distinct fuel injectors is then learned based on the measured air-fuel ratio error relative to the actively changed fuel fraction.

7 Claims, 7 Drawing Sheets

300

| ENGINE LOAD | 500 | 1000 | 2000 | 3000 | 4000 | 5000 |
|---|---|---|---|---|---|---|
| 0.9 | 1 | 0.98 | 1 | 1.01 | 1.02 | 1 |
| 0.8 | 1 | 1 | 0.98 | 0.99 | 1 | 1 |
| 0.7 | 1.01 | 1 | 0.96 | 1.03 | 1.03 | 1 |
| 0.6 | .99 | .99 | 0.97 | .99 | 0.98 | 0.99 |
| 0.5 | 0.99 | 0.97 | 0.96 | 1.01 | 1.02 | 0.98 |
| 0.4 | 1.01 | 1 | 0.98 | 1.02 | 1 | 0.97 |
| 0.3 | 0.98 | 1 | 0.99 | 1 | 1.01 | 0.98 |
| 0.2 | 0.96 | 0.99 | 1.01 | 1 | 1.02 | 0.99 |
| 0.1 | 0.97 | 0.96 | 1 | 1.02 | 1.02 | 1 |
| 0 | 0.98 | 0.99 | 1 | 1.02 | 1.02 | 1 |

ENGINE SPEED

METHODS AND SYSTEMS FOR ADJUSTING FUELING OF ENGINE CYLINDERS

FIELD

The present description relates to a system and method for supplying fuel to cylinders of an internal combustion engine.

BACKGROUND/SUMMARY

Port fuel direct injection (PFDI) engines are capable of advantageously utilizing both port injection and direct injection of fuel. For example, at higher engine loads, fuel may be injected into the engine using direct fuel injection, thereby improving engine performance (e.g., increasing available torque and fuel economy). At lower engine loads, fuel may be injected into the engine using port fuel injection, thereby reducing vehicle emissions, noise, vibration, and harshness (NVH), and wear of the direct injection system components, (e.g., injectors, DI pump solenoid valve, and the like).

In addition, in order to provide desired catalyst performance and reduced emissions, PFDI engine air-fuel ratio may be maintained at a desired level (e.g., stoichiometric ratio). Typical feedback air-fuel ratio control may include monitoring of exhaust gas oxygen concentration by one or more exhaust gas sensor and providing feedback on air-fuel ratio errors in the engine, such that the amount of fuel delivered is continuously corrected based on the feedback from the exhaust sensors. In PFDI engines, the error in air-fuel ratio may be contributed by the fuel injection system components, such as components of port and/or direct fuel injection systems. By identifying the fueling error contribution from each fuel injection system (e.g., port or direct fuel injection systems), appropriate fueling corrections may be provided and therefore, any deviation in the air-fuel ratio may be promptly corrected. As a result, catalytic converter efficiency and engine performance can be improved.

Diverse approaches may be used to identify the source of fueling errors (e.g., port or direct fuel injection systems) in PFDI systems. One example approach is shown by Surnilla et al. in U.S. Pat. No. 9,631,573 wherein a non-intrusive fuel system calibration routine is provided to identify fueling errors for each of the two fuel injection systems. The approach determines fueling errors based on a rate of change of an air-fuel ratio with respect to a change in fuel fraction of each fuel injection system at different engine operating conditions. Further, the fueling error of one fueling system may be differentiated from the error of the other fueling system by allocating distinct portions of an air-fuel ratio error to each fueling system based on the corresponding fuel fractions delivered by them.

The inventors herein have identified potential issues with the above approach. Specifically, the approach of Surnilla may be able to detect and differentiate air-fuel ratio errors associated with each fuel injection system only when the change in fraction of fuel injected by each fuel injection system is sufficiently large and/or when the injected fuel mass is significantly large. At lower injection fuel masses and smaller changes in fuel fraction, even if a total air-fuel ratio error is determined, it may be difficult to parse out the error contribution of each injection system. Even if the error is parsed out, the confidence factor of the learned error may be lower. For example, a more accurate estimation of the error may be achieved when the fuel fraction ratio of the direct injection system: port injection system is 20%:80% as compared to 40%:60%. Further, since the fueling error is identified non-intrusively, there may be limited injection events where the injection fuel mass and/or change in fuel fraction is sufficient to provide reliable test results. If injection fuel mass and/or change in fuel fraction is intrusively changed to provide the required test conditions, vehicle drivability may be affected. As yet another example, the purging of a fuel vapor canister of the fuel system may be delayed until the calibration is completed to reduce air-fuel ratio excursions caused by the purging. As such, if the canister is not purged often enough, the canister may be unable to accommodate further fuel vapors, causing emissions to be degraded. The issue may be exacerbated in hybrid vehicles where lower engine run times already limit canister purging opportunities.

The inventors herein have recognized that a measurable change in air-fuel ratio may be provided by intrusively adjusting the fuel fraction provided by each fuel injection system while maintaining the fuel fractions within an upper and lower fuel fraction limit selected for each injection system as a function of engine operating conditions. By intrusively adjusting the fuel fractions of each fuel injection system, a sufficient change in each fuel injector fuel fraction may be provided to enable a reliable detection and differentiation of air-fuel ratio error via the approach of the non-intrusive calibration routine to be implemented. In one example, fueling errors in PFDI systems may be learned by a method for an engine comprising: delivering fuel in a cylinder cycle via a direct and a port injector; increasing a direct injection fuel fraction to an upper limit when a current fraction is closer to a lower limit than the upper limit; and decreasing the first fuel fraction provided by the direct injector to the lower limit when the current fraction is closer to the upper limit than the lower limit. In this way, the source of fueling errors may be reliably identified and addressed in a timely manner.

As one example, an initial fuel fraction value may be opportunistically learned and adapted via a non-intrusive fuel calibration routine. Responsive to a predetermined amount of time having elapsed since the last (non-intrusive) fuel adaptation, an intrusive routine may be initiated. Therein, upper and lower fuel fraction limits for each fuel injection system may be determined based on engine speed-load conditions, for example. The upper and lower limits may be selected such that a significant change in fuel fraction can be achieved without degrading vehicle drivability. The controller may then compare the previously adapted fuel fraction value to the upper and lower limits, and select a fuel fraction to apply on the current adaptation based on a distance of the previously adapted fuel fraction value from each of the corresponding upper and lower limits. For example, if the previously adapted fuel fraction value of the direct injection system is determined to be further away from the upper limit, then on the current adaptation, the upper limit fuel fraction value may be applied to the direct injection system. Else, if the previously adapted fuel fraction value of the direct injection system is determined to be further away from the lower limit, then on the current adaptation, the lower limit fuel fraction value may be intrusively applied to the direct injection system. In one example, the previous non-intrusive adaptation may have been performed with 40% direct injection and 60% port injection. During the subsequent intrusive adaptation, the upper and lower limits for direct injection may be determined to be 80% and 20%. Accordingly, the intrusive adaptation may be performed with 80% direct injection and 20% port injection and the previously learned air-fuel ratio error may be updated based on the most recently learned air-fuel ratio error.

In this way, by adjusting a fuel fraction applied to each fuel injection system based on dynamically selected upper and lower limits, a significant change in fuel fraction may be provided by each injection system. The technical effect of actively providing a significant change that is constrained by predefined limits is that a fuel system calibration may be implemented wherein fueling errors may be learned with a higher confidence value. Further, by enabling the intrusive fuel fraction adaptation to be enabled only when fuel trimming is required, the engine may be operated at the desired/pre-calibrated fuel fraction value as much as possible. In addition, the amount of time required for fuel adaptation may be reduced without compromising the accuracy of the fuel adaptation, enabling more frequent fuel canister purging. By improving canister purging frequency, emissions issues are reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
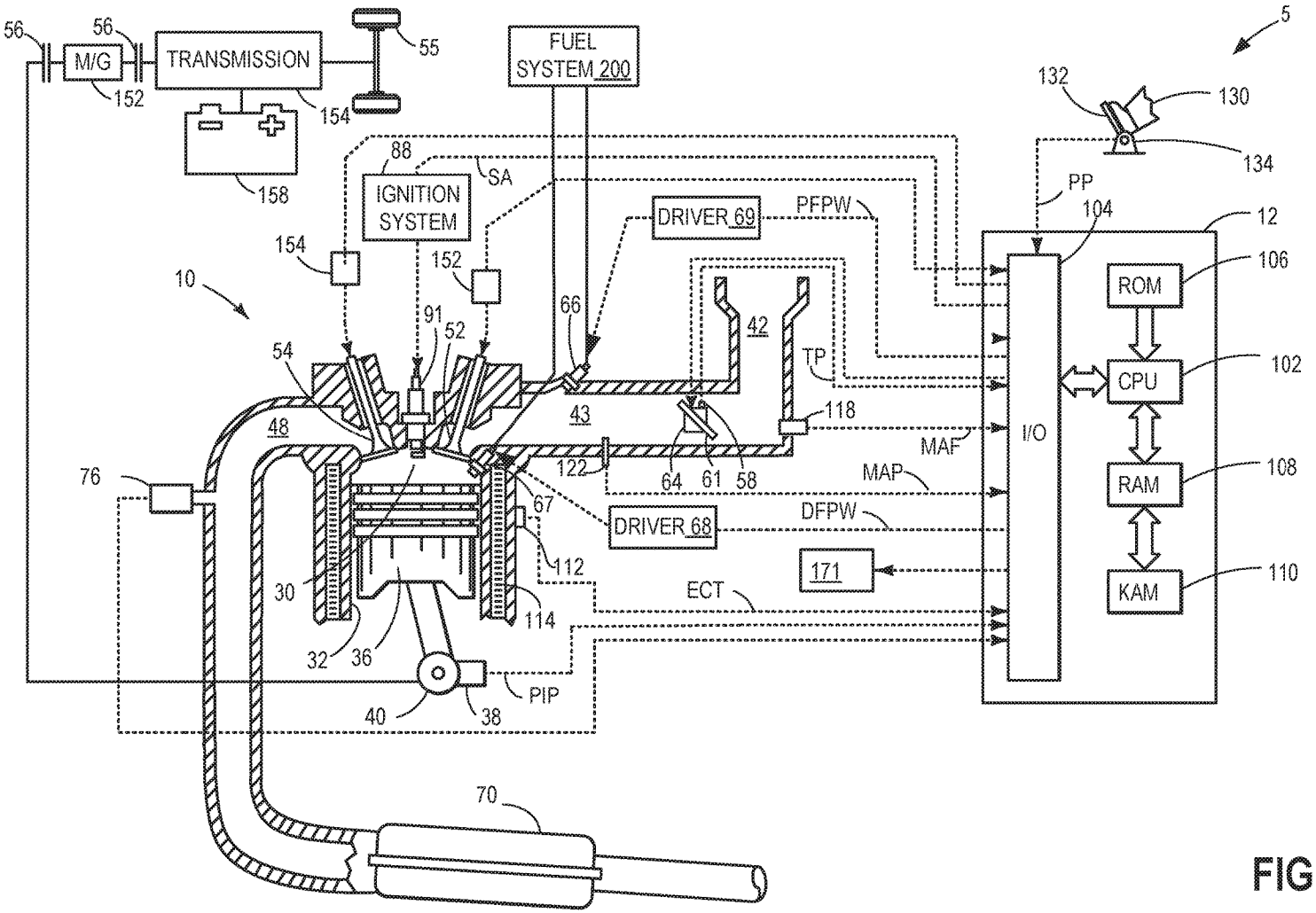
FIG. 1 shows a schematic depiction of an engine system.
Figure 2:
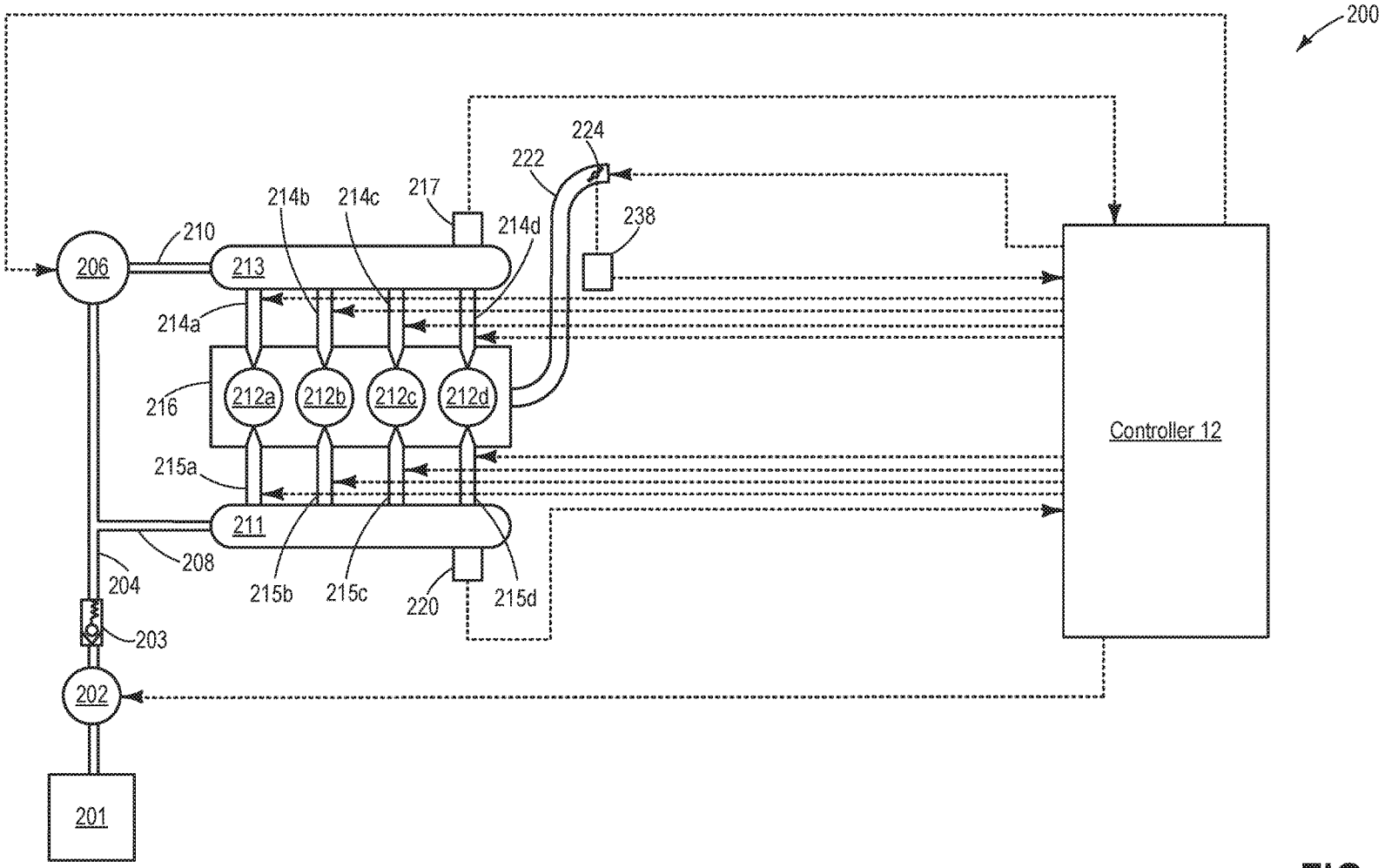
FIG. 2 shows a schematic diagram of a dual fuel injector system coupled to the engine system of FIG. 1.
Figures 3A, 3B:
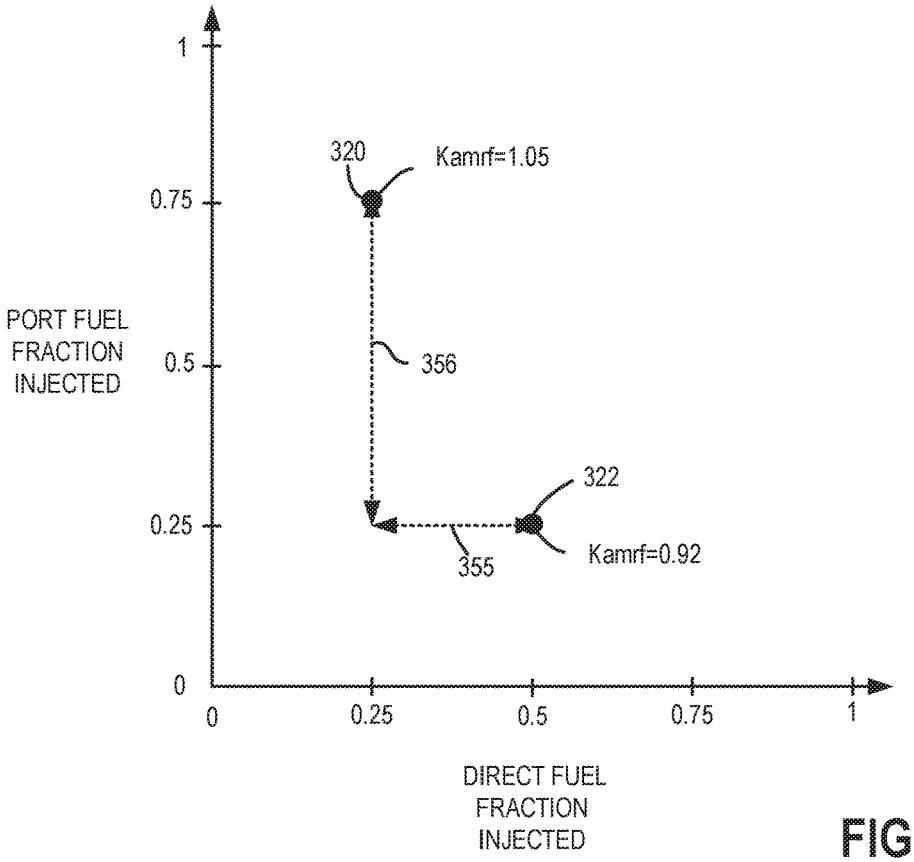
FIG. 3A shows an example table of adapted fuel multipliers.
FIG. 3B shows a graphical representation of port injected fuel and direct injected fuel error contributions determined via a non-intrusive calibration routine.

The following description relates to systems and methods for calibrating a fuel system in an engine, such as the engine system of FIG. 1, using a dual fuel injector system, such as the fuel system of FIG. 2. A controller may be configured to perform a control routine, such as the example routines of FIGS. 4-6, to learn and differentiate the source of fueling errors between direct and port injectors of an engine by opportunistically performing non-intrusive and intrusive fuel system calibrations. The learned fueling errors may be used to update an adaptive fuel multiplier table, such as the table of FIG. 3A. An initial set of errors may be learned opportunistically via a non-intrusive routine, such as shown at FIG. 3B. The errors may then be updated via an intrusive routine. A prophetic fuel system calibration wherein fueling errors are learned based on non-intrusive and intrusive calibration routines is illustrated at FIG. 7. In this way, fueling errors resulting from distinct fuel injection systems may be identified and differentiated, improving fuel injection accuracy and reducing air-fuel ratio errors.

FIG. 1 shows a schematic depiction of a spark ignition internal combustion engine 10 with a dual injector system, where engine 10 is configured with both direct and port fuel injection. Engine 10 may be included in a vehicle 5, which may be configured for on-road propulsion. Engine 10 comprises a plurality of cylinders of which one cylinder 30 (also known as combustion chamber 30) is shown in FIG. 1. Cylinder 30 of engine 10 is shown including combustion chamber walls 32 with piston 36 positioned therein and connected to crankshaft 40. A starter motor (not shown) may be coupled to crankshaft 40 via a flywheel (not shown), or alternatively, direct engine starting may be used.

Combustion chamber 30 is shown communicating with intake manifold 43 and exhaust manifold 48 via intake valve 52 and exhaust valve 54, respectively. In addition, intake manifold 43 is shown with throttle 64 which adjusts a position of throttle plate 61 to control airflow from intake passage 42.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

In another embodiment, four valves per cylinder may be used. In still another example, two intake valves and one exhaust valve per cylinder may be used.

Combustion chamber 30 can have a compression ratio, which is the ratio of volumes when piston 36 is at bottom center to top center. In one example, the compression ratio may be approximately 9:1. However, in some examples where different fuels are used, the compression ratio may be increased. For example, it may be between 10:1 and 11:1 or 11:1 and 12:1, or greater.

In some embodiments, each cylinder of engine 10 may be configured with one or more fuel injectors for providing fuel thereto. As shown in FIG. 1, cylinder 30 includes two fuel injectors, 66 and 67. Fuel injector 67 is shown directly coupled to combustion chamber 30 for delivering injected fuel directly therein in proportion to the pulse width of signal DFPW received from controller 12 via electronic driver 68. In this manner, direct fuel injector 67 provides what is known as direct injection (hereafter referred to as "DI") of fuel into combustion chamber 30. While FIG. 1 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing.

Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 delivers injected fuel in proportion to the pulse width of signal PFPW received from controller 12 via electronic driver 69.

Fuel may be delivered to fuel injectors 66 and 67 by a high pressure fuel system 200 including a fuel tank, fuel pumps, and fuel rails (elaborated at FIG. 2). Further, as shown in FIG. 2, the fuel tank and rails may each have a pressure transducer providing a signal to controller 12.

Exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst in one example.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders. In one example, sensor 76 may measure the oxygen content in the exhaust gas oxygen sensor in the exhaust pre-catalyst and provide feedback on air-fuel ratio errors in the engine to controller 12.

Distributorless ignition system 88 provides ignition spark to combustion chamber 30 via spark plug 91 in response to spark advance signal SA from controller 12.

Controller 12 may cause combustion chamber 30 to operate in a variety of combustion modes, including a homogeneous air/fuel mode and a stratified air/fuel mode by controlling injection timing, injection amounts, spray patterns, etc. Further, combined stratified and homogenous mixtures may be formed in the chamber. In one example, stratified layers may be formed by operating injector 66 during a compression stroke. In another example, a homogenous mixture may be formed by operating one or both of injectors 66 and 67 during an intake stroke (which may be open valve injection). In yet another example, a homogenous mixture may be formed by operating one or both of injectors 66 and 67 before an intake stroke (which may be closed valve injection). In still other examples, multiple injections from one or both of injectors 66 and 67 may be used during one or more strokes (e.g., intake, compression, exhaust, etc.). Even further examples may be where different injection timings and mixture formations are used under different conditions, as described below.

Controller 12 can control the amount of fuel delivered by fuel injectors 66 and 67 so that the homogeneous, stratified, or combined homogenous/stratified air/fuel mixture in chamber 30 can be selected to be at stoichiometry, a value rich of stoichiometry, or a value lean of stoichiometry. For example, the amount of fuel delivered can be varied by adjusting a pulse-width control signal commanded to each fuel injector actuator by the controller, the control signals selected based on engine speed-load conditions.

Controller 12 is shown in FIG. 1 as a conventional microcomputer including: central processing unit (CPU) 102, input/output (I/O) ports 104, read-only memory (ROM) 106, random access memory (RAM) 108, keep alive memory (KAM) 110, and a conventional data bus. Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 58 and an absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft.

In some examples, the engine may be coupled to an electric motor/battery system in a hybrid vehicle. Further, in some examples, other engine configurations may be employed, for example a diesel engine with multiple fuel injectors. Further, controller 12 may communicate conditions such as degradation of components to light, or alternatively, display panel 171.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Further, in the disclosed embodiments, an exhaust gas recirculation (EGR) system may be used to route a desired portion of exhaust gas from exhaust manifold 48 to intake manifold 43 via an EGR valve (not shown). Alternatively, a portion of combustion gases may be retained in the combustion chambers by controlling exhaust valve timing.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 152. Electric machine 152 may be a motor or a motor/generator. Crankshaft 140 of engine 10 and electric machine 152 are connected via a transmission 154 to vehicle wheels 55 when one or more clutches 56 are engaged. In the depicted example, a first clutch 56 is provided between crankshaft 140 and electric machine 152, and a second clutch 56 is provided between electric machine 152 and transmission 154. Controller 12 may send a signal to an actuator of each clutch 56 to engage or disengage the clutch, so as to connect or disconnect crankshaft 140 from electric machine 152 and the components connected thereto, and/or connect or disconnect electric machine 152 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 152 receives electrical power from a traction battery 158 to provide torque to vehicle wheels 55. Electric machine 152 may also be operated as a generator to provide electrical power to charge battery 158, for example during a braking operation.

The controller 12 receives signals from the various sensors of FIG. 1 and employs the various actuators of FIG. 1 to adjust engine operation based on the received signals and instructions stored on a memory of the controller. For example, based on engine speed signals received from a crankshaft speed sensor, the controller may select a pulse width signal to command to each of fuel injector 66 and 67.

FIG. 2 illustrates a dual injector, single fuel system 200 with a high pressure and a low pressure fuel rail system. Fuel system 200 may be coupled to an engine, such as engine 10 of FIG. 1. Components previously introduced may be similarly numbered.

Fuel system 200 may include fuel tank 201, low pressure or lift pump 202 that supplies fuel from fuel tank 201 to high pressure fuel pump 206 via low pressure passage 204. Lift pump 202 also supplies fuel at a lower pressure to low pressure fuel rail 211 via low pressure passage 208. Thus, low pressure fuel rail 211 is coupled exclusively to lift pump 202. Fuel rail 211 supplies fuel to port injectors 215*a*, 215*b*, 215*c* and 215*d*. High pressure fuel pump 206 supplies pressurized fuel to high pressure fuel rail 213 via high pressure passage 210. Thus, high pressure fuel rail 213 is coupled to each of a high pressure pump (206) and a lift pump (202).

High pressure fuel rail 213 supplies pressurized fuel to fuel injectors 214*a*, 214*b*, 214*c*, and 214*d*. The fuel rail pressure in fuel rails 211 and 213 may be monitored by pressure sensors 220 and 217 respectively. Lift pump 202 may be, in one example, an electronic return-less pump system which may be operated intermittently in a pulse mode. The engine block 216 may be coupled to an intake pathway 222 with an intake air throttle 224.

Lift pump 202 may be equipped with a check valve 203 so that the low pressure passages 204 and 208 (or alternate compliant element) hold pressure while lift pump 202 has its input energy reduced to a point where it ceases to produce flow past the check valve 203.

Direct fuel injectors 214*a*-214*d* and port fuel injectors 215*a*-215*d* inject fuel, respectively, into engine cylinders 212*a*, 212*b*, 212*c*, and 212*d* located in an engine block 216. Each cylinder, thus, can receive fuel from two injectors where the two injectors are placed in different locations. For example, as discussed earlier in FIG. 1, one injector may be configured as a direct injector coupled so as to fuel directly into a combustion chamber while the other injector is configured as a port injector coupled to the intake manifold and delivers fuel into the intake port upstream of the intake valve. Thus, cylinder 212*a* receives fuel from port injector 215*a* and direct injector 214*a* while cylinder 212*b* receives fuel from port injector 215*b* and direct injector 214*b*.

Similar to FIG. 1, the controller 12 may receive fuel pressure signals from fuel pressure sensors 220 and 217 coupled to fuel rails 211 and 213 respectively. Fuel rails 211 and 213 may also contain one or more temperature sensors for sensing the fuel temperature within the fuel rails. Controller 12 may also control operations of intake and/or exhaust valves or throttles, engine cooling fan, spark ignition, injector, and fuel pumps 202 and 206 to control engine operating conditions. Controller 12 may further receive throttle opening angle signals indicating the intake air throttle position via a throttle position sensor 238.

Fuel pumps 202 and 206 may be controlled by controller 12 as shown in FIG. 2. Controller 12 may regulate the amount or speed of fuel to be fed into fuel rails 211 and 213 by lift pump 202 and high pressure fuel pump 206 through respective fuel pump controls (not shown). Controller 12 may also completely stop fuel supply to the fuel rails 211 and 213 by shutting down pumps 202 and 206.

Injectors 214*a*-214*d* and 215*a*-215*d* may be operatively coupled to and controlled by controller 12, as is shown in FIG. 2. An amount of fuel injected from each injector and the injection timing may be determined by controller 12 from an engine map stored in the controller 12 on the basis of engine speed and/or intake throttle angle, or engine load. Each injector may be controlled via an electromagnetic valve coupled to the injector (not shown).

Fuel may be delivered by both injectors to the cylinder during a single cycle of the cylinder. For example, each injector may deliver a portion of a total fuel injection that is combusted in cylinder 30. Further, the distribution and/or relative amount of fuel delivered from each injector may vary with operating conditions, such as engine load and engine speed. The port injected fuel may be delivered during an open intake valve event, closed intake valve event (e.g. substantially before the intake stroke), as well as during both open and closed intake valve operation. Similarly, directly injected fuel may be delivered during an intake stroke, as well as partly during previous exhaust stroke, during intake stroke, and partly during the compression stroke, for example. As such, even for a single combustion event, injected fuel may be injected at different timings from the port and direct injector. Furthermore, for a single combustion even, multiple injections of the delivered fuel may be performed per cycle. The multiple injections may be performed during the compression stroke, intake stroke, or any appropriate combination thereof.

In determining the amount of fuel that needs to be delivered to the cylinder, controller 12 may be configured to determine a short term air-fuel ratio correction factor, Lambse, for adjusting the fuel delivery to compensate for rich or lean fueling errors as detected by the exhaust gas sensor 76. Lambse is typically an integral of the output signal from the exhaust gas sensor 76, and is at an average value of unity when the cylinder 30 is operating at stoichiometry and there are no steady-state air-fuel errors or offsets. For a typical example of operation, Lambse may range from 0.75-1.25.

A long term air-fuel ratio adaptive correction factor, Kamrf, (also referred herein as adaptive fuel multiplier) may be utilized to store fuel calculation correction values in an adaptive fuel multiplier table based on engine speed and load, or air charge temperature. These correction values are utilized in adjusting fuel delivery to the cylinder 30 as follows:

$$\text{Fuel_mass} = \text{air_mass} \cdot \frac{Kamrf}{\text{stoich_afr}} \cdot Lambse$$

where Fuel_mass is the fuel mass delivered to the engine, air_mass is the mass of air inducted to engine cylinders, Kamrf is the adapted fuel multiplier, stoich_afr is the stoichiometric air-fuel ratio for the fuel supplied to the engine, and Lambse is a short term air-fuel ratio correction factor for adjusting the fuel delivery to compensate for rich or lean fueling errors as detected by the exhaust gas sensor 76. In particular, Lambse is fuel correction multiplier formed by a proportional/integral controller that uses air-fueling errors as a basis for controlling engine air-fuel ratio.

Table 300 includes an X axis that partitions the table vertically into a plurality of cells that may be indexed via engine speed. Table 300 also includes a Y axis that partitions the table horizontally into the plurality of cells that may be indexed base on engine load. Thus, the X axis is identified as engine speed and the Y axis is identified as engine load. The table may be stored in KAM of controller 12 and used as feedforward fuel correction (e.g. direct injection fuel correction) throughout the engine operating range. The table is initially populated with 1's and the 1's are incremented or decremented based on exhaust gas sensor feedback. The table values may be limited or clipped to predetermined values such at between 0.75 and 1.25. Thus, for a plurality of engine speed and load combinations, the amount of fuel delivered to engine cylinders may be adjusted based on values in the table. The table output values are the variable Kamrf. If the engine has multiple cylinder banks, a plurality of Kamrf values may be provided. Kamrf may be an indication of engine air-fuel ratio error. The values in table 300 are based on an error between a desired engine air-fuel ratio and engine air-fuel ratio as determined via an oxygen sensor. Values in table 300 may be incremented or decremented based on lambse values or air-fuel ratio errors between the desired air-fuel ratio and engine air-fuel ratio as determined via an oxygen sensor, such as exhaust gas sensor 76.

Further, the amount of fuel to be delivered via port and direct fuel injection system (also referred herein as fuel fraction) is empirically determined and stored in a predetermined lookup tables or functions. For example, one table may correspond to determining port injection amounts and one table may correspond to determining direct injections amounts. The two tables may be indexed to engine operating conditions, such as engine speed and engine load, among other engine operating conditions. Furthermore, the tables may output an amount of fuel to inject via port fuel injection and/or direct injection to engine cylinders at each cylinder cycle.

Further, the relationship between fuel fractions of each injection system with Kamrf at various engine speed-load conditions may be stored in a look-up table and updated each time a new Kamrf is determined, such that air-fuel ratio error may be updated as a function of fuel fraction delivered by each fuel injection system. Further, controller 12 may also update a new fuel fraction value into KAM each time a fueling error is learned, such as when a change in fuel fraction amount delivered by each fuel injection system is detected.

The inventors herein have recognized that fueling error between port and direct injection fuel system in a PFDI fuel system may be differentiated by allocating portions of an air-fuel error based on fractions of fuel injected to a cylinder. As elaborated at FIGS. 4-6, engine air-fuel ratio errors may be non-intrusively learned via a non-intrusive fuel system calibration routine, which includes determining a difference between a commanded air-fuel ratio and an actual air-fuel ratio as measured by exhaust gas sensor 76. A portion of the air-fuel ratio error may then be allocated to a direct fuel injection system (DI_Kamrf) by calculating a ratio between a change in air-fuel ratio error and a change in fuel fraction provided by a direct injection fuel system (also referred herein as percent DI). Likewise, a portion of the air-fuel ratio error (PFI_Kamrf) may be allocated to a port fuel injection system by calculating a ratio between delta Kamrf and a change in fuel fraction provided by a port fuel injection system (also referred herein as percent PFI). It is understood that percent PFI may be calculated as (100%−percent DI), since both fuel fraction contributed by port and direct fuel injection system has to be equal to one.

In one example, if DI_Kamrf is determined to be greater than PFI_Kamrf, then fueling error may be attributed to the direct fuel injection system. However, if the opposite is true, then then fueling error may be attributed to the port fuel injection system.

Further, since the non-intrusive fuel error learning (such as the routine which will be elaborated in FIG. 5) relies on the changes in engine speed and engine load conditions, it may be possible that the percent DI does not provide sufficient changes for the non-intrusive fuel system calibration to be implemented. Thus, in order to provide sufficient changes in percent DI, an intrusive fuel system calibration may be implemented (such as the routine which will be elaborated in FIG. 6). In one example, a previously adapted percent DI learned from a non-intrusive fuel system calibration routine may be retrieved and compared with upper and lower percent DI limits determined based on the engine speed-load conditions. The intrusive fuel system calibration routine may further include changing the new percent DI value to the upper percent DI limit when the previous percent DI value is farther away from the upper percent DI limit and changing the new percent DI value to the lower percent DI limit when the previous percent DI is farther away from the lower percent DI limit. Once the new percent DI is determined, a non-intrusive fuel calibration routine may be implemented to identify fueling errors between port and direct fuel injection system, as previously mentioned. By intrusively changing the percent DI, the accuracy of the fuel error learning during non-intrusive fuel calibration may be increased. In this way, fueling error contributed by the two fueling systems may be precisely identified and promptly addressed such that engine performance may be improved. Referring now to FIG. 2, a graphical representation of port injected fuel error contributions and direct injected fuel error contributions, as learned initially via a non-intrusive or an intrusive calibration routine, is shown. In each case, a direct injected fuel fraction (and corresponding port injection fuel fraction) is commanded to operate the engine at a target air-fuel ratio, and then an actual fraction of fuel delivered is inferred based on air-fuel ratio feedback from an exhaust gas sensor, and its deviation from the target air-fuel ratio. In particular, values of an adapted fuel error multiplier (Kamrf) are plotted versus fraction of directly injected fuel and fraction of port injected fuel.

The X axis represents fraction of direct fuel injected to engine cylinders. The fraction of direct fuel injected ranges from 0 (e.g., no fuel directly injected) to 1 (e.g., all fuel direct injected during a cylinder cycle being directly injected). The Y axis represents fraction of port fuel injected to engine cylinders. The fraction of port fuel injected ranges from 0 (e.g., no fuel port injected) to 1 (e.g., all fuel port injected during a cylinder cycle being directly injected).

A first Kamrf value of 1.05 is shown at location 320. The portion of directly injected fuel for location 320 is 0.25 as indicated by dotted line 355, and the portion of port injected fuel is 0.75 as indicated by dotted line 356. The fuel fraction values of 0.25 and 0.75 add to a total of 1. Thus, the total amount or mass of fuel injected to the cylinder during a cylinder cycle multiplied by the direct fuel fraction equals the mass of directly injected fuel during the cylinder cycle. Similarly, the total mass of fuel injected to the cylinder during the cylinder cycle multiplied by the port fuel fraction equals the mass of port injected fuel during a cylinder cycle. A second Kamrf value of 0.92 is shown at location 322. The portion of directly injected fuel for location 322 is 0.5 and the portion of port injected fuel is 0.25 of the total amount of fuel injected during a cycle of the cylinder receiving the fuel.

The change in Kamrf from 320 to 322 is 1.05−0.92=0.13. The slope of the change in Kamrf with respect to the change in direct injection fraction is 0.13/(0.25−0.5)=−0.52. The slope of the change in Kamrf with respect to the change in port injection fraction is 0.13/(0.75−0.25)=0.26. Thus, the magnitude of change in Kamrf is greater with respect to the fraction of directly injected fuel that for the port injected fuel. Consequently, the direct fuel injector transfer function may be adjusted and/or the direct fuel injection system may be indicated to be in a degraded condition if the change in Kamrf with respect to the directly injected fuel fraction exceeds a threshold value.

In this way, the adapted fuel error multiplier Kamrf may be a basis for determining port fuel injection system degradation or errors. Further, the same adapted fuel error multiplier may be a basis for determining direct fuel injection system degradation errors.

In this way, the components of FIGS. 1-2 enables a system comprising an engine including a cylinder; a port fuel injector (PFI) in fluidic communication with the cylinder; a direct fuel injector (DI) in fluidic communication with the cylinder; an exhaust gas oxygen sensor for estimating an air-fuel ratio error in the cylinder; and a controller. The controller may include executable instructions stored in non-transitory memory for: estimating a split ratio of fuel delivered via the PFI relative to DI on a cylinder cycle based on engine speed and load; in response to the estimated split ratio including a higher than threshold change in DI fuel fraction since a last estimated split ratio, commanding fuel according to the estimated split ratio, and in response to the estimated split ratio including a lower than threshold change in DI fuel fraction since the last estimated split ratio, and a threshold duration having elapsed, updating the estimated split ratio based on one of an upper and a lower limit of the direct injector, the upper and lower limit estimated based on the engine speed and load, and commanding fuel according to the updated split ratio. In one example, the estimated split ratio includes a first direct injected fuel fraction and a second port injected fuel fraction, and wherein updating the estimated split ratio based on one of an upper and a lower limit of the direct injector includes, when the first direct injected fuel fraction is closer to the upper limit of the direct injector, decreasing the first direct injected fuel fraction to the lower limit and correspondingly increasing the second port injected fuel fraction; and when the first direct injected fuel fraction is closer to the lower limit of the direct injector, increasing the first direct injected fuel fraction to the upper limit and correspondingly decreasing the second port injected fuel fraction. In a further example, the controller may include further instructions for: distributing the air-fuel ratio error estimated after commanding fuel according to the estimated split ratio between the port injector and the direct injector based on a rate of change of the air-fuel error relative to the estimated split ratio; and distributing the air-fuel ratio error estimated after commanding fuel according to the updated split ratio between the port injector and the direct injector based on the rate of change of the air-fuel error relative to the updated split ratio. In a still further example, distributing the air-fuel ratio error includes assigning a first portion of the air-fuel ratio error to the direct injector and a remaining, second portion of the air-fuel ratio error to the port injector, and wherein the controller includes further instructions for: responsive to the first portion exceeding the second portion, limiting direct injector operation; and responsive to the second portion exceeding the first portion, limiting port injector operation.

Figure 4:
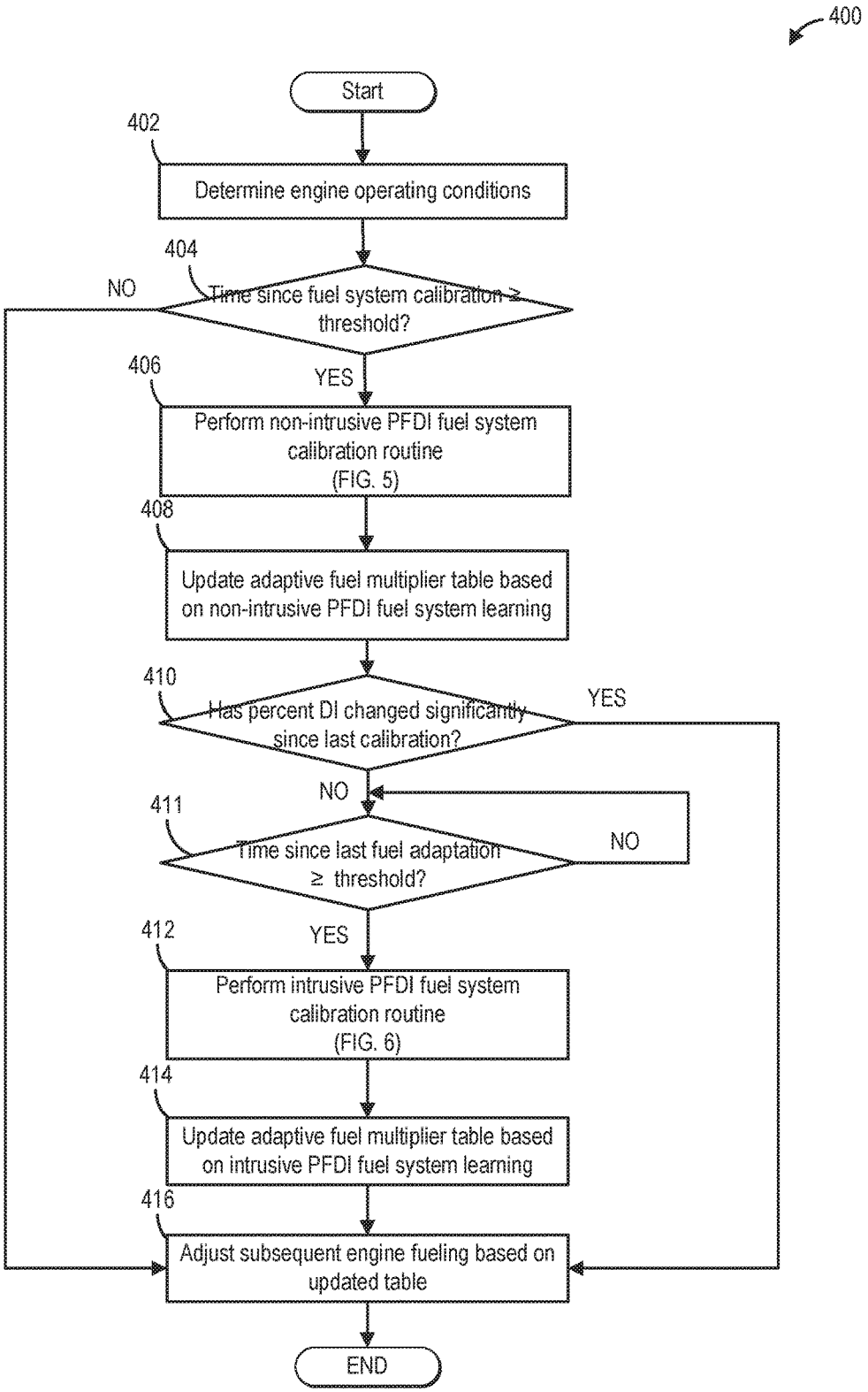
FIG. 4 is a high-level flowchart illustrating an example routine for performing fuel system calibration in a dual fuel injector system.

Referring now to FIG. 4, an example routine for calibrating PFDI fuel systems is shown. Instructions for carrying out routine 400 and the rest of the methods included herein may be executed by a controller, such as controller 12 of FIGS. 1 and 2, based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 402, engine operating conditions may be estimated and/or inferred. These may include, for example, engine speed, engine load, driver torque demand, ambient conditions (e.g. ambient temperature and humidity, and barometric pressure), MAP, MAF, MAT, engine temperature, boost level, etc.

Once the engine operating conditions are estimated, the method proceeds to 404, where it is determined if a threshold duration has elapsed since a last iteration of a non-intrusive fuel system calibration routine. In one example, fuel system calibration may be periodically performed, such as at least once per drive cycle, after a predetermined number of miles have been driven, or after a predetermined duration of engine operation. The non-intrusive fuel system calibration may be performed opportunistically using fuel fraction values selected as engine speed-load varies.

If the threshold duration has not elapsed, then the method proceeds to 416, where fueling to cylinders is continued to be adjusted based on the most recent fuel multiplier table. This may include applying the most recent adaptive fuel multiplier value (Kamrf) based on the estimated engine speed/load conditions and applying the corresponding direct fuel fraction and port fuel fraction based on the recent Kamrf value. In one example, the controller may retrieve the most recent Kamrf value from a look-up table stored in the controller's memory, such as the table of FIG. 3A. The method then ends.

If sufficient time has elapsed since the last iteration of the fuel system calibration, method 400 proceeds to 406 where a non-intrusive PFDI fuel system calibration routine is performed, as will be described with reference to FIG. 5. The non-intrusive fuel system calibration routine may include learning and updating an adaptive fuel multiplier value, Kamrf, each time the routine is implemented. Further, degraded fuel injector may be indicated when DI_Kamrf or PFI_Kamrf exceeds a threshold, for example. Further still, fueling error between the port fuel and direct fuel injection systems may be identified by comparing DI_Kamrf versus PFI_Kamrf, as elaborated below.

At 308, upon completing the calibration routine, the adaptive fuel multiplier table is updated into the controller's memory based on the non-intrusive PFDI fuel system learning. In one example, the adaptive fuel multiplier table may be indexed based on engine speed and engine load, and may provide Kamrf as the output value, such as shown with reference to the table of FIG. 3A. In one example, the updated Kamrf values may be incremented or decremented from the previous Kamrf values based on the air-fuel ratio errors between the commanded air-fuel ratio and actual air-fuel ratio as determined via exhaust gas sensor (e.g. gas sensor 76 of FIG. 1). In another example, a change in DI percent may also be updated. As elaborated at FIG. 4, the adaptive fuel multiplier may further update information regarding the state of each fuel injection system. For example, a flag may be set for the direct fuel injection system when DI_Kamrf exceeds a threshold. Likewise, a flag for the port fuel injection system may be set when PFI_Kamrf exceeds a threshold. Alternatively, an error counter for each fuel injection system may be incremented each time a flag is set, such that when the error count reaches a threshold, a Malfunction Indicator Lamp (MIL) may be provided to alert the vehicle operator the need to repair or replace the corresponding degraded fuel injector.

At 410, it may be determined if a percent DI (that is, a fuel fraction provided by the direct fuel injection system) has changed significantly since the last fuel calibration. The significant change may include a higher than threshold change in the percent DI that is sufficiently large for the non-intrusive fuel system calibration to be implemented again, opportunistically. The threshold change may alternatively include a calibratable number of counts to mature and a calibratable number of times that maturing can fail before an intrusive DI calibration is performed. For example, it may be determined that the non-intrusive fuel system calibration may be optionally reiterated after every 10 seconds. As such, the non-intrusive calibration may require a significant fuel fraction change so that the corresponding measured air-fuel ratio error can be detected and reliably attributed to the change in DI fueling or the change in PFI fueling. Therefore, if the change in DI percent is significant, no intrusive fuel system calibration is required and the method proceeds to 416, where the fuel multiplier table continues to be updated based on opportunistic runs of the non-intrusive calibration routine, and fueling to cylinders is continued to be adjusted based on the most recent fuel multiplier table.

However, if a significant percent DI change is not detected, the method proceeds to 411. At 411, it may be determined if the time elapsed since the last fuel adaptation has exceeded a threshold duration. In one example, determining the duration since the last fuel adaptation may include determining if any fuel correction value, such as Kamrf, percent DI, etc., has been recently updated, and if so, starting a timer and determining if the duration elapsed since the starting of the time has exceeded the threshold duration. In another example, it may also include determining if any fueling error in the fuel injection system has occurred, and if so, the duration elapsed since then (e.g., as measured via a timer). Responsive to each of the threshold duration having has elapsed since the last fuel adaptation, and the less than threshold change in DI percent, the method proceeds to 412 to perform an intrusive PFDI fuel system calibration routine. Else, the method returns to 411 where the timer continues to be incremented until the threshold duration is reached.

At 412, an intrusive PFDI fuel system calibration routine is performed, as will be described with reference to FIG. 6. The intrusive fuel system calibration routine may include retrieving the last adapted DI percent value and comparing it upper and lower percent DI limits of the DI injector, the upper and lower percent DI limits dynamically determined based on real-time engine speed/load conditions. Further, the percent DI may be actively transitioned to the upper percent DI limit if the previously adapted percent DI value is farther away from the upper percent DI limit, or actively transitioned to the lower percent DI limit if the previously adapted percent DI value is farther away from the lower percent DI limit. By intrusively adjusting the percent DI, the source of fueling error (e.g. port and/or direct fuel injection system) may be accurately identified.

In this way, the adaptive fuel error learning strategy first attempts to learn the fueling error without any intrusive percent DI changes. If the adaptive strategy is not detecting sufficient changes in percent DI, then the controller forces a percent DI change and runs the engine with an alternate percent DI that allows the adaptive fuel strategy to learn the fueling error more reliably.

After an intrusive fuel system calibration has been completed, the method proceeds to 414, where the fuel multiplier table is updated based on the intrusive fuel system learning. Similar to step 408, updating the fuel multiplier table may include incrementing or decrementing Kamrf values based on air-fuel ratio errors between the commanded air-fuel ratio and actual air-fuel ratio as determined via exhaust gas sensor (e.g. gas sensor 76 of FIG. 1). In one example, the Kamrf values learned during the non-intrusive calibration may be replaced with the Kamrf values learned during the intrusive calibration. In another example, the Kamrf values learned during the non-intrusive calibration may be updated as a weighted average of the Kamrf values learned during the intrusive and non-intrusive calibrations. As yet another example, the Kamrf values learned during the non-intrusive calibration may be updated as a function of a difference between the Kamrf values learned during the non-intrusive calibration and the Kamrf values learned during the intrusive calibration. The intrusive and non-intrusive calibrations may then work together to mature the long term fuel trim values. As more updates to the adaptation occur, the gains will decrease until a final long term fuel trim is determined. Updating the adaptive fuel multiplier may further include updating a new percent DI value for a given engine speed-load condition.

At 416, a subsequent engine fueling event may be adjusted based on the updated table. In one example, the fuel fraction for each fuel injection system in a look-up table may be adjusted based on the updated Kamrf value. In another example, if a degradation is indicated in one of the fuel injection systems, the operation of the degraded fuel injection system may be limited to prevent further damage to the injector and consequently, the operation of the non-degraded fuel injection system may be temporarily increased.

In one example, updating the transfer function for the injectors may include assigning a first portion of the measured air-fuel ratio error to the direct injector based on a rate of change of the air-fuel ratio relative to the increased or decreased direct injection fuel fraction and a second portion of the air-fuel ratio error to the port injector based on the rate of change of the air-fuel ratio error relative to the port injection fuel fraction. Further, the controller may update the transfer function of the direct injector based on the first portion of the air-fuel ratio error; and updating the transfer function of the port injector based on the second portion of the air-fuel ratio error. Then, the controller may limit operation of the direct injector when the first portion is greater than the second portion, and limit operation of the port injector when the second portion is greater than the first portion. In this way, additional fueling errors are averted.

Figure 5:
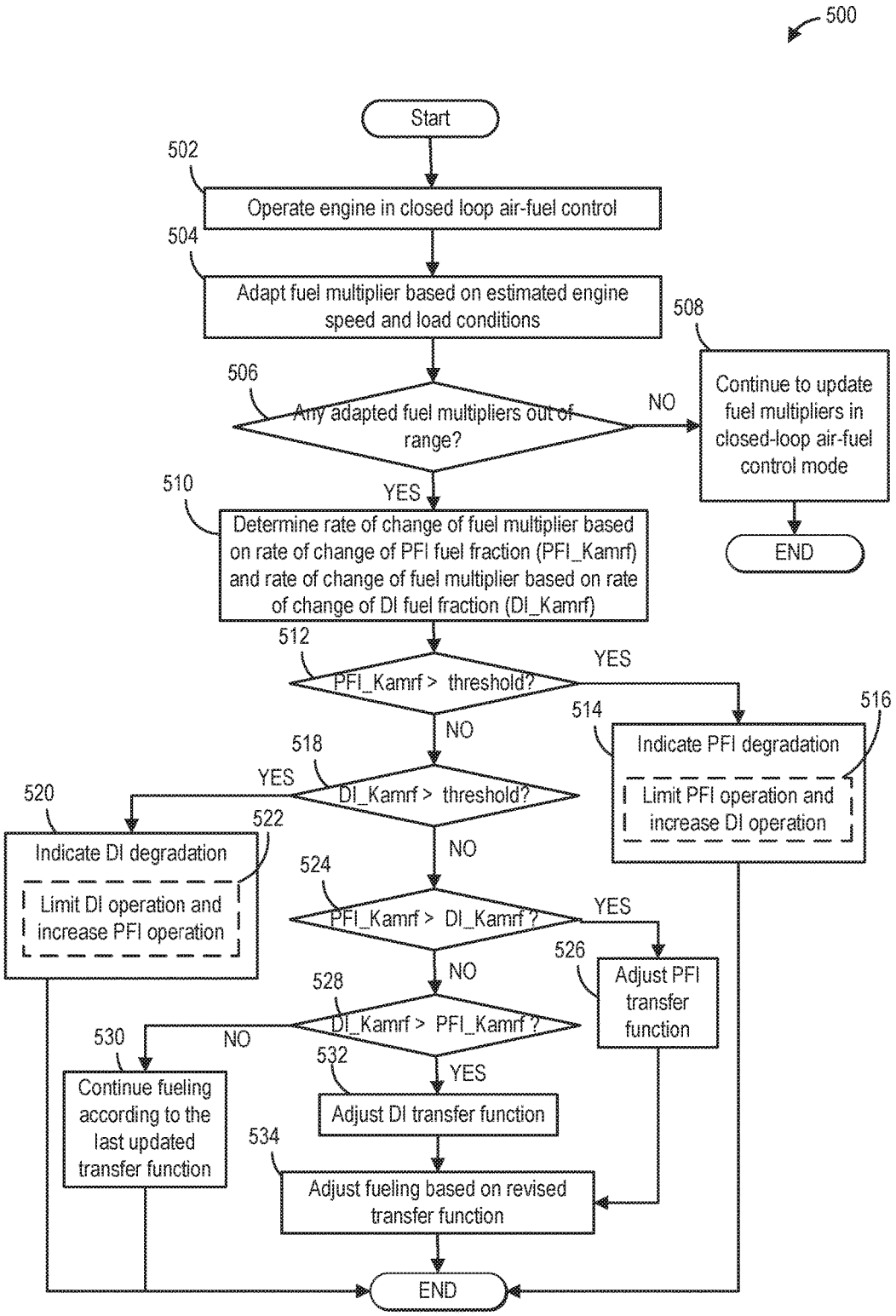
FIG. 5 is a flowchart demonstrating an example routine for adaptively learning fueling errors in a dual fuel injector system.

Referring now to FIG. 5, an example routine 500 for performing a non-intrusive fuel system calibration is shown. In one example, the routine of FIG. 5 may be performed as part of the routine of FIG. 4, such as at 406. Specifically, routine 500 describes a method for determining and isolating degraded fueling sources (e.g. port or direct fuel injection system) in a dual injection, single fuel system. Further, routine 500 also describes mitigating actions for conditions when degradation of a given fuel injection system is determined. The non-intrusive fuel system calibration routine of FIG. 5 may be triggered responsive to a significantly large percent DI change being detected. In addition, the source of fueling error (e.g. port fuel or direct fuel injection system) may be precisely identified and thus, fueling errors caused by the specific injection system may be promptly addressed.

At 502, the engine is operated in a closed loop air-fuel control mode. In one example, the closed-loop control mode may be initiated during idle and cruise operations and may make adjustments to fuel injection based on signals received from the exhaust gas sensor (such as sensor 76 of FIG. 1). During closed loop air-fuel control, the controller may determine a desired engine air-fuel ratio by indexing tables and/or functions based on various engine operating conditions, such as driver demand torque, engine speed, and other conditions. In one example, the air-fuel ratio may be maintained at a stoichiometric ratio. Fuel is supplied to provide the desired engine air-fuel ratio and the feedback from exhaust gas sensor (e.g. exhaust gas sensor 76 of FIG. 1) is used to adjust each fuel injector fuel fraction. Depending on the fuel fraction, fuel may be port-injected, direct-injected, or both. Once the engine is operating a closed-loop, the method continues to 504.

At 504, a fuel multiplier (Kamrf) is adapted based on the estimated engine speed and engine load conditions. In one example, a Kamrf value may be adapted based on if the exhaust gas sensor is observing lean or rich fuel mixture combustion products in the exhaust system. In another example, if the short-term air-fuel ratio correction factor, lambse, is indicating lean air-fuel ratio over an extended time period, the adapted fuel multiplier (Kamrf) may be incremented from its initial value to a richer air-fuel value and vice versa. In addition, the fuel multiplier may be adapted at a plurality of engine speed and load conditions. Additionally, the fuel fractions of port-injected fuel and direct-injected fuel may be stored in the same table where the adapted fuel multiplier is stored. An example fuel multiplier adaptation is described earlier with reference to FIG. 3B. Method then proceeds to 506 after the fuel multiplier is adapted.

At 506, it may be determined if any of the adapted fuel multipliers are out of range. In one example, the controller may determine if the Kamrf values stored in the adaptive fuel multiplier table is between 0.75 and 1.25. Alternatively, the method may also determine if a sufficient number of adapted fuel multipliers have been stored to memory (e.g., at least two distinct adapted fuel multipliers and their corresponding direct injection fuel fraction and port injection fuel fraction have been stored in memory). If the fuel multipliers are within range, then the method proceeds to 510. Otherwise, the method proceeds to 508 where a plurality of fuel multipliers continues to be updated in the closed-loop air-fuel control mode for different engine speed-load conditions and the method ends.

At 510, the rate of change of fuel multiplier based on rate of change of port-fuel injection fuel fraction (PFI_Kamrf) and the rate of change of fuel multiplier based on rate of change of direct fuel injection fuel fraction (DI_Kamrf) are determined. The relationship between the rate of change of the adapted fuel multipliers and the change in direct injected fuel fraction may be expressed as:

$$\frac{d(Kamrf)}{d(di_{frac})} = \text{DI_Kamrf}$$

where DI_Kamrf is the slope of rate of change of Kamrf with respect to a change in direct injection fuel fraction, where Kamrf is the adapted fuel multiplier, and $di_{frac}$ is the direct injection fuel fraction. And, the relationship between the rate of change of the adapted fuel multipliers and the change in port injected fuel fraction may be expressed as:

$$\frac{d(Kamrf)}{d(1 - di_{frac})} = \text{PFI_Kamrf}$$

where PFI_Kamrf is the slope of rate of change of Kamrf with respect to a change in port injected fuel fraction, where Kamrf is the adapted fuel multiplier, and $di_{frac}$ is the direct injection fuel fraction. Further, information on Karmf and its corresponding direct fuel injector and port fuel injector fuel fractions may be stored as a sub-table in the adaptive multiplier table, for example. The sub-table may be indexed based on direct fuel injector and port fuel injector fuel fractions. In addition, the fraction of direct fuel and port fuel may range from 0 (e.g., no fuel directly injected) to 1 (e.g., all fuel direct injected during a cylinder cycle being directly injected).

As an example, a first Kamrf value may be determined to be 1.05 based on the first estimated engine speed-load conditions. In another example, the first Kamrf value may also be inferred from a look-up table (e.g. adaptive fuel multiplier table). Further, the fuel fraction values for direct fuel injection and port fuel injection may be determined from the sub-table. Thus, based on the Karmf value at 1.05, $di_{frac}$ and $pfi_{frac}$ may be determined to be 0.25 and 0.75, respectively. At a second engine speed-load condition, a second Kamrf may be determined to be 0.92. In this case, the fuel fraction values for direct fuel injection and port fuel injection may be determined to be $di_{frac}$=0.5 and $pfi_{frac}$=0.25, respectively.

Based on the determined first and second Kamrf values, DI_Kamrf and PFI_Kamrf may be computed. For example, DI_Kamrf may be (1.05−0.92)/(0.25−0.5)=−0.52. And, PFI_Kamrf may be calculated to be (1.05−0.92)/(0.75−0.25) =0.26.

As shown with reference to the example of FIG. 3A, by determining the slope of rate of change of Kamrf with respect to a change in port injected fuel fraction, and the slope of rate of change of Kamrf with respect to a change in direct injected fuel fraction, engine fueling errors may be allocated between port and direct fuel injection systems. For example, the greater the absolute value of the slope of rate of change of Kamrf with respect to a change in direct injected fuel fraction, the greater amount of fueling error is attributed to the direct fuel injection system. Once the DI_Kamrf and PFI_Kamrf are determined, the method proceeds to 512.

At 512, it may be determined if the absolute value of PFI_Kamrf exceeds a threshold. In one example, the threshold may be a predetermined number provided by the vehicle manufacturer. In another example, the threshold may be learned and adapted based on the vehicle operating conditions (e.g. engine speed, engine load, etc.). If the absolute value of PFI_Kamrf exceeds a threshold, the method proceeds to 514, where PFI degradation is indicated. Indicating PFI degradation may include alerting the vehicle operator by activating a malfunction indicator lamp (MIL). In another example, the PFI degradation may be indicated via a display panel (such as display panel 171 of FIG. 1). Indicating PFI degradation may further include limiting PFI operation and correspondingly increasing DI operation at 516. For example, an operating range for port fuel injection may be reduced and direct fuel injection may be used in place of port fuel injector during operating conditions where port fuel injection was previously used. As another example, after determining an initial DI: PFI fuel fraction based on engine operating conditions, the PFI fuel fraction may be reduced while the DI fraction is correspondingly increased responsive to the indication of PFI degradation. The reduction in the PFI fuel fraction may be determined based on a difference between the learned absolute value of PFI_Kamrf relative to the threshold, the PFI fuel fraction reduced further (from the initial value) as the difference increases. Then, the method ends.

However, if the absolute value of PFI_Karmf does not exceed a threshold, then the method proceeds to 518, where it is determined if the absolute value of DI_Kamrf exceeds a threshold. Similar to the threshold used for assessing the PFI system, the threshold may be a predetermined number provided by the vehicle manufacturer. In another example, the threshold may be learned and adapted based on the vehicle operating conditions (e.g. engine speed, engine load, etc.). The threshold for DI_Karmf may be identical or different value the threshold for PFI_Kamrf.

If the absolute value of DI_Kamrf value exceeds the corresponding threshold, then the method proceeds to 520, where DI degradation is indicated. Further, at 522, the method includes limiting DI operation while correspondingly increasing PFI operation. For example, an operating range for direct fuel injection may be reduced and port fuel injection may be used in place of direct fuel injection during operating conditions where direct fuel injection was previously used. As another example, after determining an initial DI: PFI fuel fraction based on engine operating conditions, the DI fuel fraction may be reduced while the PFI fraction is correspondingly increased responsive to the indication of DI degradation. The reduction in the DI fuel fraction may be determined based on a difference between the learned absolute value of DI_Kamrf relative to the threshold, the DI fuel fraction reduced further (from the initial value) as the difference increases. The method then ends.

If neither the absolute value of DI_Kamrf nor the absolute value of PFI_Kamrf exceeds their corresponding threshold, method 500 proceeds to 524 where it is determined if the absolute value of PFI_Kamrf is greater than the absolute value of DI_Kamrf. For example, it may be determined if PFI_Kamrf exceeds DI_Kamrf by more than a threshold amount. If PFI_Kamrf is greater than DI_Kamrf (e.g., by more than the threshold amount), the controller may determine that a fueling error, such as measured based on feedback from the air-fuel ratio sensor, is attributed to the port fuel injection system. Thus, at 526, the transfer function of the port fuel injection system may be updated accordingly (e.g., by adjusting an offset or slope function of the port fuel injection system).

However, if PFI_Kamrf is not greater than DI_Kamrf, then method proceeds to 528, where it is determined if the absolute value DI_Kamrf greater than the absolute value of PFI_Kamrf. For example, it may be determined if DI_Kamrf exceeds PFI_Kamrf by more than a threshold amount. If DI_Kamrf is greater than PFI_Kamrf (e.g., by more than the threshold amount), the controller may then determine that the fueling error, such as measured based on feedback from the air-fuel ratio sensor, is attributed to the direct fuel injection system. Thus, at 530, the transfer function of direct fuel injection system may be updated accordingly (e.g., by adjusting an offset or slope function of the direct fuel injection system).

Returning to the earlier example, the absolute value of DI_Kamrf and PFI_Kamrf may be 0.52 and 0.26, respectively. Thus, the magnitude of change in Kamrf is greater with respect to the fuel fraction of the direct fuel injector (i.e. DI_Kamrf>PFI_Kamrf). As a result, the fueling error may be attributed to the direct fuel injection system and the transfer function of the direct fuel injection system may be further adjusted via adjusting the slope or offset of the transfer function, for example. Accordingly, the direct injector pulse-width commanded during a subsequent fueling event may increase or decrease.

If, at 528, DI_Kamrf is determined to not be greater than PFI_Kamrf, that is, DI_Kamrf and PFI_Kamrf are within a range of each other, the proceeds to 530, where fueling from both direct and port fuel injection systems is continued according to the last updated transfer function, and the method ends.

From each of 526 and 532, the method moves to 534. At 534, the fueling of both the port fuel and direct injection system during subsequent fueling events may be based on the revised transfer function(s). In one example, a total fuel amount, as well as a fuel fraction delivered via each of the port and direct injector may be incremented or decremented according to the revised transfer function so that the commanded fuel mass better matches the desired fuel mass for the given engine operating conditions. Further, the updated values of various fuel correction factors, such as fuel multiplier Kamrf, change in percent DI, and the fuel injector transfer functions, may be stored in the controller's memory, such as in a look-up table as a function of engine speed and load.

In this way, by conducting a non-intrusive calibration routine, the source of fueling errors in the fuel injection system may be promptly identified without affecting drivability, and mitigating actions may be provided such that further fueling errors may be avoided. In one example, the controller may increase the operation of a first non-degraded fuel injection system in the presence of a second degraded fuel injection system. Further, fuel injection degradation indication may allow fuel system repair service to be provided in a timely manner.

Figure 6:
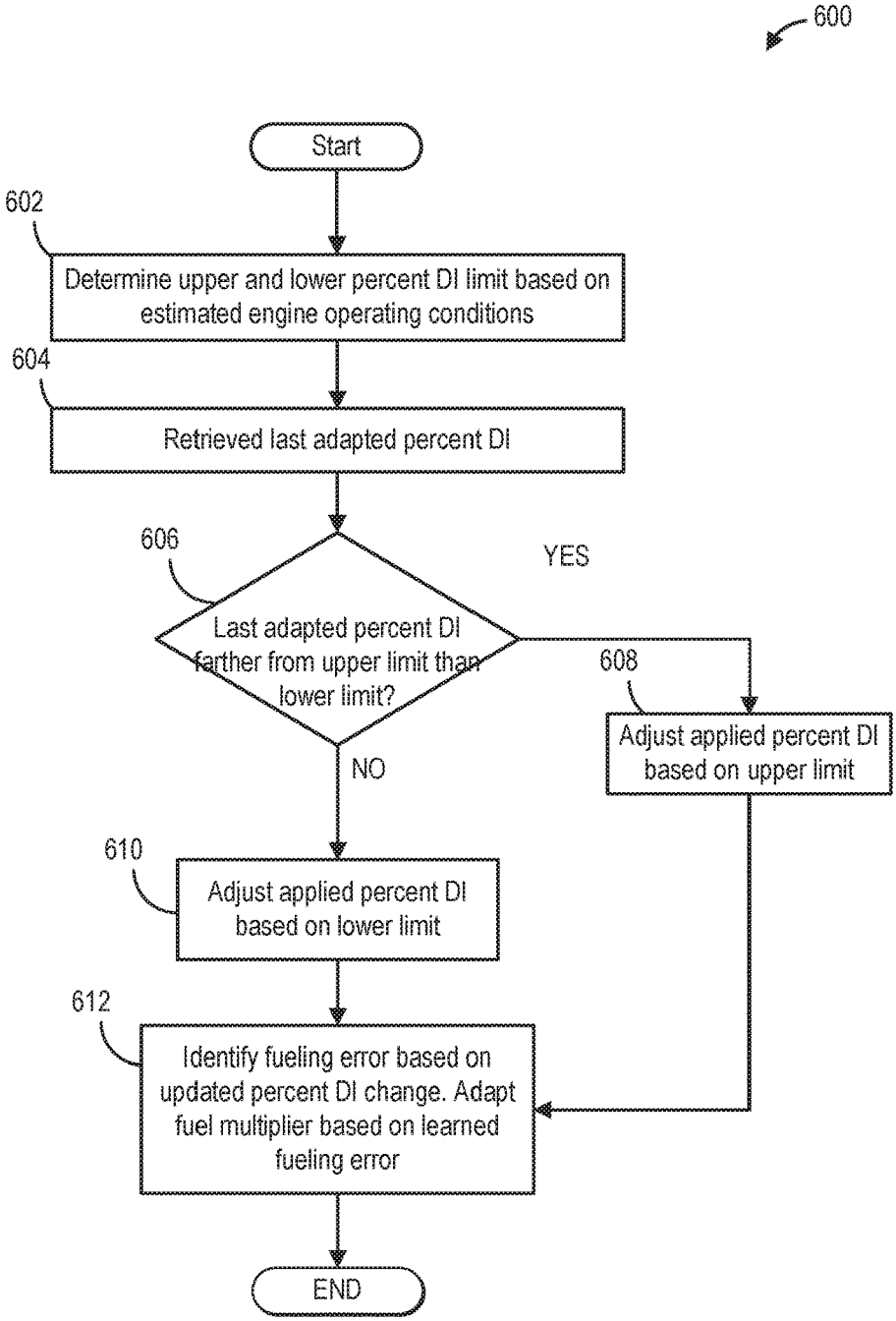
FIG. 6 is a flowchart illustrating an example routine for intrusively adjusting injector fuel fraction in a dual fuel injector system.
Figure 7:
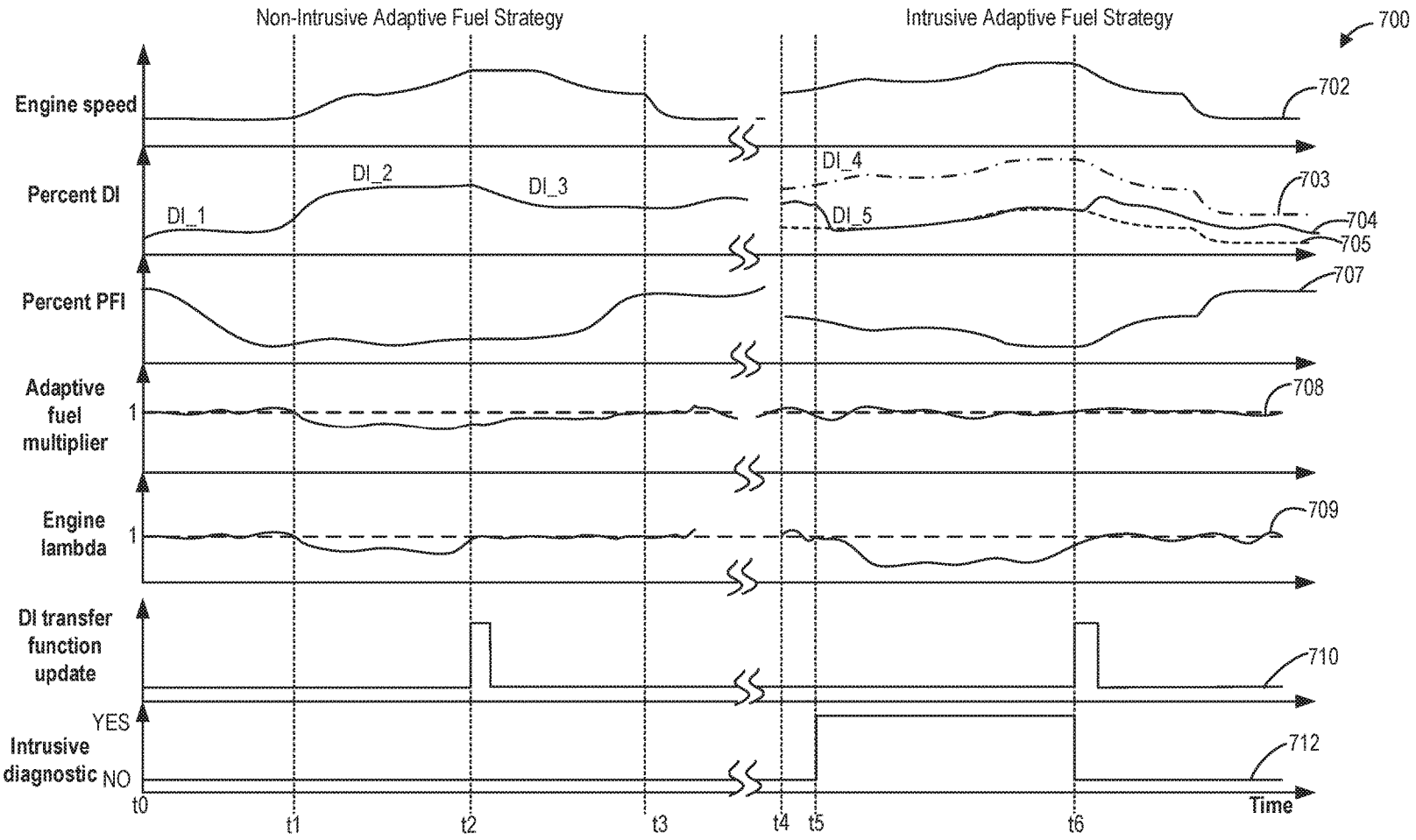
FIG. 7 shows a graph illustrating an example fuel system calibration in a dual fuel injector system.

Referring now to FIG. 6, an example routine for performing an intrusive fuel system calibration is illustrated. In one example, the routine of FIG. 6 may be performed as part of the routine of FIG. 4, such as at 412. The method allows for an intrusive fuel adjusting strategy to be implemented such that sufficient changes in a percent DI (i.e. fuel fraction provided by direct fuel injection system) can be actively induced to reliably identify fueling errors without degrading vehicle drivability.

At 602, an upper and lower percent limit may be determined for the DI system (herein also referred to as the upper and lower DI limit) based on estimated engine operating conditions (e.g., engine speed-load conditions). The upper and lower limits may be selected so as reduce the impacts of an intrusive change in fuel fraction on NVH, drivability, emissions and engine torque. In one example, the upper and lower limit of a direct injection fuel fraction may be provided in a look-up table indexed based on engine speed and engine load. In one example, the upper and lower limit may be 67% and 41%, respectively, during a first engine speed-load condition. In another example, the upper and lower limit during a second engine speed-load condition may be 15% and 0%, respectively. The upper and lower limits may both be separate speed/load calibration maps. Various design considerations may be made when picking the values for these maps. For example, at idle engine speeds/loads, the lower and upper limits might both be 0% DI. This is because some engines/vehicles cannot tolerate the NVH from the DI fuel system when the vehicle is stationary at idle. The earlier referenced 67% and 41% example may be applied when the DI fuel system would run out of fuel at 67% but the PFI injection system would not provide enough charge air cooling at anything less than 47%, so these limits would protect for fuel flow restrictions and combustion knock limitations. Once the upper and lower percent DI limits are determined, the method proceeds to 604.

At 604, the last adapted percent DI may be retrieved. In one example, the last adapted percent DI may be retrieved from the adaptive fuel multiplier table (such as the table of FIG. 3A) updated during the previous non-intrusive fuel PFDI fuel system learning (such as step 408 of FIG. 4 and step 510 of FIG. 5). In another example, the last adapted percent DI may be a pre-calibrated value set by the vehicle manufacturer. In one example, the last adapted DI percent may be 58% during a first engine speed-load condition and 0% during a second engine speed-load condition, where 58% DI means that 58% of the fuel mass is provided by the direct fuel injector and the remaining (100%−58%) 42% of the fuel mass is provided by the port fuel injector, while 0% DI means that 100% of the fuel mass is provided by the port fuel injector (e.g., during low load conditions). Once the last adapted percent DI is retrieved, the method proceeds to 608.

At 606, it may be determined if the last adapted percent DI is farther away from the upper DI limit relative to the lower DI limit. For example, a first difference between the last adapted percent DI value and the upper DI limit may be compared to a second difference between the last adapted percent DI value and the lower DI limit. If the first difference is larger than the second difference, it may be determined that the last adapted percent DI is farther away from the upper DI limit. Else, if the first difference is smaller than the second difference, it may be determined that the last adapted percent DI is farther away from the lower DI limit. If the last adapted percent DI is farther away from the upper limit, then at 608, the method includes adjusting the percent DI commanded based on the upper percent DI limit. For example, the percent DI may be actively changed from the last adapted percent DI value to the upper DI limit value. However, if the last adapted percent DI is closer to the upper limit, then the method proceeds to 610, where the percent DI commanded is adjusted based on the lower limit. For example, the percent DI may be actively changed from the last adapted percent DI value to the lower DI limit value. If the first difference is the same as the second difference, the upper limit may be selected, as a default, due to a preference for operating with direct injection.

In this way, the controller may deliver fuel in a cylinder cycle via a direct and a port injector; and increasing a direct injection fuel fraction to an upper limit when a current fraction is closer to a lower limit than the upper limit while decreasing the first fuel fraction provided by the direct injector to the lower limit when the current fraction is closer to the upper limit than the lower limit. Herein, the direct injection fuel fraction is increased or decreased relative to a port injection fuel fraction, wherein each of the upper limit and the lower limit are for the direct injector and are based on engine operating conditions including engine speed, load, and operator torque demand. The controller may then update a transfer function of the direct injector based on an air-fuel ratio error relative to the increased or decreased fuel fraction. Additionally, a port injection fuel fraction may be based on the direct injection fuel fraction, and the controller may further update a transfer function of the port injector based on the air-fuel ratio error relative to the port injection fuel fraction.

It will be appreciated that the increasing or decreasing of the fuel fraction is performed responsive to a threshold duration having elapsed since a last updating of the transfer function of the direct injector. As such, if the threshold duration has not elapsed since the last updating of the transfer function, the controller may continue to deliver fuel in the cylinder cycle via the direct injector and the port injector at the current fraction, and update the transfer function of the direct injector, not intrusively, but opportunistically, based on the rate of change of the air-fuel ratio error relative to the current fraction (as elaborated at FIG. 5).

In one example, by adjusting the new percent DI to the upper limit, the operation of port-fuel injection at higher engine speed/load may be prevented and thus engine power consumption may be decreased. In another example, by adjusting the new percent DI value to the lower limit at low load condition, more fuel may be delivered by the port fuel injection system and negative impacts to NVH may be avoided. Once a sufficient change is detected in the percent DI value, a non-intrusive fuel calibration may be implemented, as elaborated in FIG. 5. Further, by performing an intrusive fuel calibration routine, less time may be needed for the controller software (e.g., powertrain control software) to adapt to the fuel error. Further still, by reducing the time to run the fuel system calibration routine, fuel tank purging capability may be improved since fuel purging system may not be activated until fuel system calibration has been completed.

With reference to the earlier during the first engine speed-load condition, the last adapted percent DI may be 58% (the current fuel fraction), the upper limit may be 67% and the lower limit may be 41%. The first difference between the last adapted percent DI and the upper limit (67−58=9%) is smaller than the second difference between the last adapted percent DI and the lower limit (58−41=17%). Therefore, the percent DI is forced to the lower limit, that is, transitioned from 58% to 41%. Herein, even though the engine speed-load conditions warrant the use of 58% DI, the controller actively reduces the percent DI applied to 41% while correspondingly increasing the percent PFI applied, so as to provide a measurable change in DI fuel fraction that enables accurate fueling error learning. As another example, during the second engine speed-load condition, the last adapted percent DI may be 0%, which is farther away from the upper limit (15%) and closer to the lower limit (0%). Therefore, during the second engine speed-load condition, the percent DI applied may be actively adjusted to the upper limit, that is, transitioned from 0% to 15%. Herein, even though the engine speed-load conditions warrant the use of no DI, the controller actively increases the percent DI applied to 15% while correspondingly decreasing the percent PFI applied, so as to provide a measurable change in DI fuel fraction that enables accurate fueling error learning.

In one example, the current fraction determined based only on engine operating conditions includes a lower than threshold change in direct injection fuel fraction since a last updating of the transfer function. In comparison, each of the increased and decreased fuel fraction includes a higher than threshold change in the direct injection fuel fraction. By actively providing a higher than threshold change in the direct injection fuel fraction, a significant change in DI fuel fraction is provided that allows fueling error to be learned with a higher confidence factor.

From each of 608 and 610, the method moves to 612 to adaptively learn the fuel multipliers for each of the DI and PFI fuel systems based on feedback from an exhaust air-fuel ratio sensor, as elaborated earlier at FIGS. 4-5. For example, based on the intrusively provided (higher than threshold) change in DI fuel fraction and the corresponding change in air-fuel ratio, a fueling error for the DI system may be learned and an adaptive multiplier for the DI fuel system may be correspondingly determined.

In this way, the amount of time required for an engine controller to adapt a fuel error is reduced. By enabling the engine to run at the desired or pre-calibrated percent DI as much as possible, fuel errors may be learned non-intrusively. By forcing the engine to run at an updated percent DI only when fuel trim needs to be adapted, fuel errors may be more reliably learned while reducing the frequency and duration of intrusive learning. By learning the adaptive fuel error and fuel trim more accurately, canister purging can be implemented opportunistically.

Referring now to FIG. 7, an example fuel system calibration diagnostic is shown. The example includes learning a fueling error via a non-intrusive fuel system calibration routine (between t0 to t3) and learning a fueling error by intrusively adjusting percent DI via an intrusive fuel system calibration routine (between t4 to t5). Map 700 depicts engine speed at plot 702, percent DI at 704, percent PFI at plot 707, an adaptive fuel multiplier at 708, engine lambda at plot 709, DI transfer function update at 710, and an intrusive fueling error diagnostic request at 712. All plots are depicted over time along the x-axis. Time markers t1-t6 depict time points of significance during fuel system calibration.

Prior to t1, the engine is operated in a low speed-low load region (plot 702) wherein the engine cylinders are fueling with a higher fraction of port injected fuel (plot 707) relative to direct injected fuel (plot 704) maintaining operating the engine with a target exhaust air-fuel ratio, such as at or around stoichiometry. The DI percent at this time is DI_1. Larger port fuel injection fractions may be desirable at lower engine loads since port injected fuel vaporizes well at lower engine loads and direct injection fuel pump may be reduced when the direct injection fuel amount is low. The engine air-fuel ratio feedback correction lambse value is oscillating about a value of one. The adaptive fuel multiplier, Kamrf, fluctuates around the desired value (around 1.00) and the controller is continuously updating the DI and PFI fuel amounts based on the fuel multiplier values as a function of the engine speed-load condition. Between t0 and t1, there is no significant change in DI fuel fraction, and so no fuel calibration is implemented. Therefore the DI transfer function is not updated and no intrusive diagnostic request is performed. Direct injector transfer functions are not being updated as indicated by the direct injector transfer function update state. The direct injection fuel fraction, port injected fuel fraction, and adaptive fuel multiplier are stored in memory (not shown).

At t1, the vehicle operator requested engine torque demand may increase (such as due the operator increasing accelerator pedal depression). As a result, engine speed increases and a higher proportion of the total fuel mass may be delivered as direct injected fuel. The percent DI is increased from DI_1 to DI_2 while the percent PFI is correspondingly decreased to maintain the exhaust air-fuel ratio at stoichiometry. The change in percent DI at t1 (from DI_1 to DI_2), is large enough to trigger a non-intrusive fuel calibration routine. A change in the output of an exhaust gas sensor (and the resulting change in lambda) is compared to the change in commanded DI percent. The controller detects a rich air fuel ratio error and based on its comparison with the change in percent DI, the Kamrf is dropped to a lower value (e.g. Kamrf is dropped from 1.00 to 0.92). The rich error indicates that there is more fuel being delivered than commanded, though at this time it is unclear whether the excess fuel is due to the direct injector or the port injector (or both). A rate of change of the fuel multiplier is compared to each of the rate of change of PFI fuel fraction (PFI_Karmf) and to the rate of change of the DI fuel fraction (DI_Kamrf). Based on the DI_Kamrf having a greater absolute value than PFI_Kamrf, the learned fueling error may be attributed to the direct fuel injection system.

Responsive to indication that the fueling error is due to the direct fuel injection system, at t2, the transfer function for the DI fuel system is updated (plot 710). After t2, the DI fuel percent is determined in accordance with the updated transfer function such that the DI percent applied (DI_3), is less than the corresponding DI fuel fraction provided before t2 (DI_2), at a constant engine load. As a result of the correction, lambda returns to 1.0. In addition, the Kamrf value may be updated into an adaptive multiplier table. The non-intrusive calibration routine may then end. At t3, there is a decrease in operator torque demand resulting in an increase in PFI percent and a corresponding drop in DI percent. The drop in DI percent is not significantly larger at this time, therefore the non-intrusive calibration is not re-initiated.

At t4, conditions for an intrusive fuel system calibration routine conditions may be considered met, for example, due to a threshold duration having elapsed since a last fuel adaptation. Accordingly, the last adapted percent DI (DI_3) is retrieved. The controller may then determine an upper limit for the percent DI (DI_4 at plot 703) and a lower limit for the percent DI (DI_5 at plot 705) based on the engine speed-load conditions. The controller then compares the last adapted percent DI (DI_3) to upper and lower DI percent limits (DI_4 and DI_5) to select one of the limits that is further away. In the present example, at t4, the controller may determine that the last adapted percent DI is farther away from the lower limit. Therefore at t5, the intrusive routine is initiated with the percent DI (plot 704) adjusted to the lower limit (DI_5). By changing the percent DI based on the lower limit, a sufficiently large percent DI change may be effectuated, which may allow the non-intrusive routine to learn fueling error in the PFDI systems. Between t5 and t6, as at t1-t2, the adaptive fuel multiplier is changed based on feedback regarding the change in lambda. The change in adaptive fuel multiplier is then correlated with the commanded change in DI percent (D3 to D5) to learn the DI fueling error. The DI transfer function is then updated based on the learning, such that after t6, the engine may resume being fueled based on engine operating conditions with the updated transfer function.

In this way, an engine controller may estimate each of a current direct injection (DI) fuel fraction, a DI upper limit, and a DI lower limit as operator torque demand changes.

Then, during a first condition, the controller may command the current DI fuel fraction and learn a DI transfer function based on an air-fuel ratio error relative to the current DI fuel fraction (non-intrusively, as shown at t1-t3). In comparison, during a second condition, the controller may command one of the DI upper limit and the lower limit, and learn the DI transfer function based on the air-fuel ratio error relative to the commanded upper or lower limit (intrusively, as shown at t4-t6). In one example, during the first condition, the current DI fuel fraction includes a higher than threshold change in fuel fraction since a last commanded DI fuel fraction, while during the second condition, the current DI fuel fraction includes a lower than threshold change in fuel fraction since the last commanded DI fuel fraction. In another example, the first condition includes a lower than threshold duration having elapsed since a last learning of the DI transfer function, and the second condition includes a higher than threshold duration having elapsed since the last learning of the DI transfer function. In the preceding examples, the commanding during the second condition may include commanding the DI upper limit when the current DI fuel fraction is further from the DI upper limit than the lower limit, and commanding the DI lower limit when the current DI fuel fraction is further from the DI lower limit than the upper limit, wherein commanding the DI upper limit includes increasing the current DI fuel fraction to the DI upper limit and wherein commanding the DI lower limit includes decreasing the current DI fuel fraction to the DI lower limit. In a further example, during the first condition, the target DI fuel fraction is commanded non-intrusively, while during the second condition, the one of the upper and DI limit is commanded intrusively, while overriding the current DI fuel fraction, and wherein during each of the first and second condition, the engine is operated in closed loop air-fuel ratio control to determine the air-fuel ratio error. In a further example, the air-fuel ratio error is in a form of an adapted fuel multiplier, and the method further comprises during the first condition, commanding a port injection (PFI) fuel fraction based on the current DI fuel fraction and learning a PFI transfer function based on the air-fuel ratio error relative to the commanded PFI fuel fraction; and during the second condition, commanding the port injection (PFI) fuel fraction based on the commanded one of the upper and lower DI limit and learning the PFI transfer function based on the air-fuel ratio error relative to the commanded PFI fuel fraction. In another example, the engine is coupled in a hybrid vehicle, and the method further comprises, during the first condition, enabling purging of fuel vapors from a canister to an engine intake later during a drive cycle of the vehicle, and during the second condition, enabling purging of the fuel vapors from the canister to the engine intake earlier during the drive cycle of the vehicle.

In this way, fueling error contributions from a direct injection system may be better separated from those due to a port injection system. By enabling the error to be precisely identified and promptly addressed, engine performance may be improved. By enabling an intrusive fuel fraction adjustment, a target change in DI fuel fraction can be provided that increases the reliability and confidence factor of the fuel error learning. By adjusting the intrusive fuel fraction adjustment as a function of calibrated fuel fraction upper and lower limits, engine NVH, drivability, and emissions may be maintained even when the intrusive operation is performed. By enabling the intrusive calibration to be selectively and intermittently performed only when fuel adaptation (or fuel trim) is required, the engine may be operated at a desired/pre-calibrated fuel fraction for a longer portion of a drive cycle, improving engine drivability. By coordinating the use of intrusive and non-intrusive fueling error learning routines, the amount of time required for fuel adaptation may be shortened, allowing a fuel canister purging operation to be initiated earlier in a drive cycle, since fuel purging may only be enabled once fuel adaptation is complete. As such, this enables a more complete canister purging to be performed. The technical effect of identifying the fueling error contribution from each fuel injection system is that any deviations in the air-fuel ratio may be promptly compensated for, leading to improved catalytic converter efficiency and engine performance.

One example method comprises: delivering fuel in a cylinder cycle via a direct and a port injector; increasing a direct injection fuel fraction to an upper limit when a current fraction is closer to a lower limit than the upper limit; and decreasing the first fuel fraction provided by the direct injector to the lower limit when the current fraction is closer to the upper limit than the lower limit. In the preceding example, additionally or optionally, the direct injection fuel fraction is increased or decreased relative to a port injection fuel fraction, and wherein each of the upper limit and the lower limit are for the direct injector and are based on engine operating conditions including engine speed, load, and operator torque demand. In any or all of the preceding examples, additionally or optionally, the method further comprises updating a transfer function of the direct injector based on an air-fuel ratio error relative to the increased or decreased fuel fraction. In any or all of the preceding examples, additionally or optionally, the port injection fuel fraction is based on the direct injection fuel fraction, the method further comprising, updating a transfer function of the port injector based on the air-fuel ratio error relative to the port injection fuel fraction. In any or all of the preceding examples, additionally or optionally, the increasing or decreasing the fuel fraction is responsive to a threshold duration having elapsed since a last updating of the transfer function of the direct injector. In any or all of the preceding examples, additionally or optionally, the current fraction includes a lower than threshold change in direct injection fuel fraction since a last updating of the transfer function, and wherein each of the increased and decreased fuel fraction includes a higher than threshold change in the direct injection fuel fraction. In any or all of the preceding examples, additionally or optionally, the method further comprises, responsive to less than the threshold duration having elapsed since the last updating of the transfer function, delivering fuel in the cylinder cycle via the direct injector and the port injector at the current fraction, and updating the transfer function of the direct injector based on the rate of change of the air-fuel ratio error relative to the current fraction. In any or all of the preceding examples, additionally or optionally, updating the transfer function includes assigning a first portion of the air-fuel ratio error to the direct injector based on a rate of change of the air-fuel ratio relative to the increased or decreased direct injection fuel fraction and a second portion of the air-fuel ratio error to the port injector based on the rate of change of the air-fuel ratio error relative to the port injection fuel fraction; updating the transfer function of the direct injector based on the first portion of the air-fuel ratio error; and updating the transfer function of the port injector based on the second portion of the air-fuel ratio error. In any or all of the preceding examples, additionally or optionally, the method further comprises limiting operation of the direct injector when the first portion is greater than the second portion, and limiting operation of the port injector when the second portion is greater than the first portion.

Another example method for an engine comprises: estimating each of a current direct injection (DI) fuel fraction, a DI upper limit, and a DI lower limit as operator torque demand changes, during a first condition, commanding the current DI fuel fraction and learning a DI transfer function based on an air-fuel ratio error relative to the current DI fuel fraction; and during a second condition, commanding one of the DI upper limit and the lower limit, and learning the DI transfer function based on the air-fuel ratio error relative to the commanded upper or lower limit. In the preceding example, additionally or optionally, during the first condition, the current DI fuel fraction includes a higher than threshold change in fuel fraction since a last commanded DI fuel fraction, and wherein during the second condition, the current DI fuel fraction includes a lower than threshold change in fuel fraction since the last commanded DI fuel fraction. In any or all of the preceding examples, additionally or optionally, the first condition includes a lower than threshold duration having elapsed since a last learning of the DI transfer function, and wherein the second condition includes a higher than threshold duration having elapsed since the last learning of the DI transfer function. In any or all of the preceding examples, additionally or optionally, the commanding during the second condition includes commanding the DI upper limit when the current DI fuel fraction is further from the DI upper limit than the lower limit, and commanding the DI lower limit when the current DI fuel fraction is further from the DI lower limit than the upper limit, wherein commanding the DI upper limit includes increasing the current DI fuel fraction to the DI upper limit and wherein commanding the DI lower limit includes decreasing the current DI fuel fraction to the DI lower limit. In any or all of the preceding examples, additionally or optionally, during the first condition, the target DI fuel fraction is commanded non-intrusively, wherein during the second condition, the one of the upper and DI limit is commanded intrusively, while overriding the current DI fuel fraction, and wherein during each of the first and second condition, the engine is operated in closed loop air-fuel ratio control to determine the air-fuel ratio error. In any or all of the preceding examples, additionally or optionally, the air-fuel ratio error is in a form of an adapted fuel multiplier, the method further comprising: during the first condition, commanding a port injection (PFI) fuel fraction based on the current DI fuel fraction and learning a PFI transfer function based on the air-fuel ratio error relative to the commanded PFI fuel fraction; and during the second condition, commanding the port injection (PFI) fuel fraction based on the commanded one of the upper and lower DI limit and learning the PFI transfer function based on the air-fuel ratio error relative to the commanded PFI fuel fraction. In any or all of the preceding examples, additionally or optionally, the engine is coupled in a hybrid vehicle, the method further comprising, during the first condition, enabling purging of fuel vapors from a canister to an engine intake later during a drive cycle of the vehicle, and during the second condition, enabling purging of the fuel vapors from the canister to the engine intake earlier during the drive cycle of the vehicle.

Another example system comprises: an engine including a cylinder; a port fuel injector (PFI) in fluidic communication with the cylinder; a direct fuel injector (DI) in fluidic communication with the cylinder; an exhaust gas oxygen sensor for estimating an air-fuel ratio error in the cylinder; and a controller including executable instructions stored in non-transitory memory for: estimating a split ratio of fuel delivered via the PFI relative to DI on a cylinder cycle based on engine speed and load; in response to the estimated split ratio including a higher than threshold change in DI fuel fraction since a last estimated split ratio, commanding fuel according to the estimated split ratio, and in response to the estimated split ratio including a lower than threshold change in DI fuel fraction since the last estimated split ratio, and a threshold duration having elapsed, updating the estimated split ratio based on one of an upper and a lower limit of the direct injector, the upper and lower limit estimated based on the engine speed and load, and commanding fuel according to the updated split ratio. In the preceding example, additionally or optionally, the estimated split ratio includes a first direct injected fuel fraction and a second port injected fuel fraction, and wherein updating the estimated split ratio based on one of an upper and a lower limit of the direct injector includes: when the first direct injected fuel fraction is closer to the upper limit of the direct injector, decreasing the first direct injected fuel fraction to the lower limit and correspondingly increasing the second port injected fuel fraction; and when the first direct injected fuel fraction is closer to the lower limit of the direct injector, increasing the first direct injected fuel fraction to the upper limit and correspondingly decreasing the second port injected fuel fraction. In any or all of the preceding examples, additionally or optionally, the controller includes further instructions for distributing the air-fuel ratio error estimated after commanding fuel according to the estimated split ratio between the port injector and the direct injector based on a rate of change of the air-fuel error relative to the estimated split ratio; and distributing the air-fuel ratio error estimated after commanding fuel according to the updated split ratio between the port injector and the direct injector based on the rate of change of the air-fuel error relative to the updated split ratio. In any or all of the preceding examples, additionally or optionally, distributing the air-fuel ratio error includes assigning a first portion of the air-fuel ratio error to the direct injector and a remaining, second portion of the air-fuel ratio error to the port injector, and wherein the controller includes further instructions for responsive to the first portion exceeding the second portion, limiting direct injector operation; and responsive to the second portion exceeding the first portion, limiting port injector operation. In a further representation, the engine is coupled in a hybrid vehicle system.

In a further representation, a method comprises delivering fuel on a cylinder cycle via a direct and a port injector, a first fuel fraction provided by the direct injector set to one of an upper and a lower limit of the direct injector, the upper and lower limit based on engine operating conditions; and updating a transfer function of the direct injector based on an air-fuel ratio error relative to the first fuel fraction. In the preceding example, the method additionally or optionally further comprises estimating a target fuel fraction to be provided by the direct injector based on the engine speed and load; setting the first fuel fraction to the upper limit of the direct injector when a difference between the target fuel fraction and the upper limit is larger than the difference between the target fuel fraction and the lower limit; and setting the first fuel fraction to the lower limit of the direct injector when the difference between the target fuel fraction and the upper limit is larger than the difference between the target fuel fraction and the lower limit. In any or all of the preceding examples, additionally or optionally, the operating conditions include engine speed and load.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

estimating each of a current direct injection (DI) fuel fraction, a DI upper limit, and a DI lower limit as operator torque demand changes, wherein the DI upper limit and the DI lower limit are based on engine speed and engine load;

during a first condition, non-intrusively commanding the current DI fuel fraction and learning a DI transfer function based on an air-fuel ratio error relative to the current DI fuel fraction;

during a second condition, intrusively commanding one of the DI upper limit and the DI lower limit, and learning the DI transfer function based on the air-fuel ratio error relative to the commanded DI upper or DI lower limit; and delivering fuel to a cylinder of the engine via a direct injector and a port injector based on the learned DI transfer function.

2. The method of claim 1, wherein during the first condition, the current DI fuel fraction includes a higher than threshold change in fuel fraction since a last commanded DI fuel fraction, and wherein during the second condition, the current DI fuel fraction includes a lower than threshold change in fuel fraction since the last commanded DI fuel fraction.

3. The method of claim 1, wherein the first condition includes a lower than threshold duration having elapsed since a last learning of the DI transfer function, and wherein the second condition includes a higher than threshold duration having elapsed since the last learning of the DI transfer function.

4. The method of claim 1, wherein the commanding during the second condition includes commanding the DI upper limit when the current DI fuel fraction is further from the DI upper limit than the DI lower limit, and commanding the DI lower limit when the current DI fuel fraction is further from the DI lower limit than the DI upper limit, wherein commanding the DI upper limit includes increasing the current DI fuel fraction to the DI upper limit and wherein commanding the DI lower limit includes decreasing the current DI fuel fraction to the DI lower limit.

5. The method of claim 1, wherein during the first condition, a target DI fuel fraction is commanded non-intrusively, wherein during the second condition, the one of the DI upper limit and the DI lower limit is commanded intrusively, while overriding the current DI fuel fraction, and wherein during each of the first and second conditions, the engine is operated in a closed loop air-fuel ratio control to determine the air-fuel ratio error.

6. The method of claim 1, wherein the air-fuel ratio error is in a form of an adapted fuel multiplier, the method further comprising:

during the first condition, commanding a port injection (PFI) fuel fraction based on the current DI fuel fraction and learning a PFI transfer function based on the air-fuel ratio error relative to the commanded PFI fuel fraction; and during the second condition, commanding the PFI fuel fraction based on the commanded one of the upper DI limit and the lower DI limit and learning the PFI transfer function based on the air-fuel ratio error relative to the commanded PFI fuel fraction.

7. The method of claim 1, wherein the engine is coupled in a hybrid vehicle, the method further comprising, during the first condition, enabling purging of fuel vapors from a canister to an engine intake later during a drive cycle of the vehicle, and during the second condition, enabling purging of the fuel vapors from the canister to the engine intake earlier during the drive cycle of the vehicle.

* * * * *